US006270428B1

(12) United States Patent
Kuttappa

(10) Patent No.: US 6,270,428 B1
(45) Date of Patent: Aug. 7, 2001

(54) HEAVY FILLER IN GOLF BALL CORES

(76) Inventor: Sanjay M. Kuttappa, 354 Isoaqueena Trial, Apt. 504, Central, SC (US) 29630

( * ) Notice: Subject to any disclaimer, the term of this patent is extended or adjusted under 35 U.S.C. 154(b) by 0 days.

(21) Appl. No.: 09/353,905

(22) Filed: Jul. 15, 1999

Related U.S. Application Data

(60) Provisional application No. 60/093,229, filed on Jul. 17, 1998.

(51) Int. Cl.[7] ..... A63B 37/06; B29C 43/18

(52) U.S. Cl. ..... 473/367; 264/248

(58) Field of Search ..... 473/356, 370, 473/371, 361, 367; 264/248, 250, 279.1, 347

(56) References Cited

U.S. PATENT DOCUMENTS

| | | | | |
|---|---|---|---|---|
| 4,625,964 | | 12/1986 | Yamada | 273/62 |
| 4,650,193 | | 3/1987 | Molitor | 273/228 |
| 4,714,253 | | 12/1987 | Nakahara et al. | 273/228 |
| 4,781,383 | | 11/1988 | Kamada et al. | 273/228 |
| 4,848,770 | | 7/1989 | Shama | 273/228 |
| 4,863,167 | * | 9/1989 | Matsuki et al. | 473/373 |
| 4,979,746 | | 12/1990 | Gentiluomo | 273/220 |
| 5,002,281 | | 3/1991 | Nakahara et al. | 273/220 |
| 5,048,838 | | 9/1991 | Chikaraishi et al. | 273/228 |
| 5,072,944 | | 12/1991 | Nakahara et al. | 273/220 |
| 5,104,126 | | 4/1992 | Gentiluomo | 273/228 |
| 5,184,828 | | 2/1993 | Kim et al. | 273/228 |
| 5,253,871 | | 10/1993 | Viollaz | 273/228 |
| 5,273,286 | | 12/1993 | Sun | 273/228 |
| 5,340,112 | | 8/1994 | Hamada et al. | 273/226 |
| 5,439,227 | | 8/1995 | Egashira | 273/228 |
| 5,482,285 | | 1/1996 | Yabuki et al. | 273/228 |
| 5,490,674 | | 2/1996 | Hamada | 273/228 |
| 5,792,009 | * | 8/1998 | Maruko | 473/359 |
| 5,935,022 | | 8/1999 | Sugimoto et al. | 473/373 |

FOREIGN PATENT DOCUMENTS

| | | | |
|---|---|---|---|
| 0661 083 A1 | 12/1994 | (EP) | A63B/37/00 |
| 0665 267 A2 | 12/1994 | (EP) | C08L/9/00 |
| 2167 309A | 12/1994 | (GB) | C08L/9/00 |

* cited by examiner

*Primary Examiner*—Mark S. Graham
*Assistant Examiner*—Raeann Gorden

(57) ABSTRACT

Two and three piece golf balls having improved rebound characteristics include cores and centers, respectively, that are comprised of polybutadiene rubber and inorganic fillers with specific gravities of about 5.4 or greater. The inorganic fillers may be selected from tungsten, bismuth, copper, bismuth oxide, nickel, cobalt, iron, steel, tin, chromium, zinc, bismuth subcarbonate, cupric oxide, barium tungstate, cuprous oxide or ferrous oxide.

14 Claims, 1 Drawing Sheet

HEAVY FILLER IN GOLF BALL CORES

CROSS-REFERENCE TO RELATED APPLICATION

A claim of benefit is made to U.S. Provisional Application Ser. No. 60/093,229 filed Jul. 17, 1998, the contents of which are incorporated herein by reference.

BACKGROUND OF THE INVENTION

1. Field of the Invention

The invention relates generally to compositions for golf balls. More specifically, the invention relates to fillers for golf ball centers and cores.

2. Description of the Related Art

One of the parameters of golf ball performance that receives great attention is flight distance. Although there are a variety of factors that influence a golf ball's flight distance, perhaps the most important factor relates to the rebound characteristics of the ball which is dictated in large part by the materials used to construct the golf ball.

As is well known in the industry, there are a number of different types of golf balls. The predominant varieties are a two-piece and a three-piece golf ball. A two piece golf ball is typically constructed with a solid core and a cover. A three-piece ball is typically a thread wound solid center with a cover. Within these two broad categories are numerous variations such a liquid filled centers for three-piece balls. Regardless of the particular golf ball type, all golf balls have rebound characteristics that are dictated by the materials and construction type utilized.

To conform to United States Golf Association ("U.S.G.A.") guidelines and regulations, golf balls have to be constructed to meet specific weight requirements. When a golf ball core or center composition is below specified weight requirements, one of the techniques used to increase weight is to add fillers to the centers and cores of three-piece golf balls and two-piece golf balls, respectively. Conventional fillers used include calcium carbonate (specific gravity of 2.73), barium sulfate (sp. gr. of 4.3) and zinc oxide (sp. gr. 5.6). Although these materials can be effectively used to increase the weight of a golf ball, the inevitable volume occupied by these materials when incorporated into a center or core results in a reduction in the polymer/rubber content of the center or core. By extending the rubber with fillers or reducing the polymer/rubber content, the coefficient of restitution of the resulting golf ball is reduced which translates into reduced flight distance.

The compression of a golf ball is a measure of the deflection of the golf ball under a load of 200 lbs. The Professional Golf Association (PGA) measures compression as (0.180"−deflection)×100. Typically, the lower the PGA compression the softer the golf ball. The softer golf ball (with a softer core and/or cover) exhibits better feel, click and spin characteristics when compared with a high compression golf ball.

An additional detrimental side effect of high stiffness content is that a high loading of fillers stiffens the rubber compound and increases the compression of the core or center while reducing the resilience properties.

It has now been discovered that the incorporation of high density materials such as tungsten into cores and centers can be used to meet golf ball weight requirements without significantly reducing the coefficient of restitution or increasing the compression of the golf ball produced. In some instances, the opposite effect has been observed.

It is thus an object of the invention to provide a golf ball center or core composition that uses high specific gravity fillers in order to maintain the weight of a conventional golf ball core or center having a lower compression without significantly compromising the resilience characteristics of the golf ball in which such a center or core is incorporated. A further object is to meet the USGA golf ball weight requirements without increasing the golf ball compression.

SUMMARY OF THE INVENTION

The invention described herein relates to the addition of high density inorganic powders of metals and oxides that can be used to increase the weight of a center for a two-piece golf ball and the core of a three-piece wound golf ball without significantly compromising the rebound characteristics of the golf ball produced. The fillers used have a high specific gravity of about 5.4 and higher.

These objects and features of the present invention will be apparent from a review of the drawings and a reading of the following detailed description of the invention.

DETAILED DESCRIPTION OF THE INVENTION

Figures 1, 2:
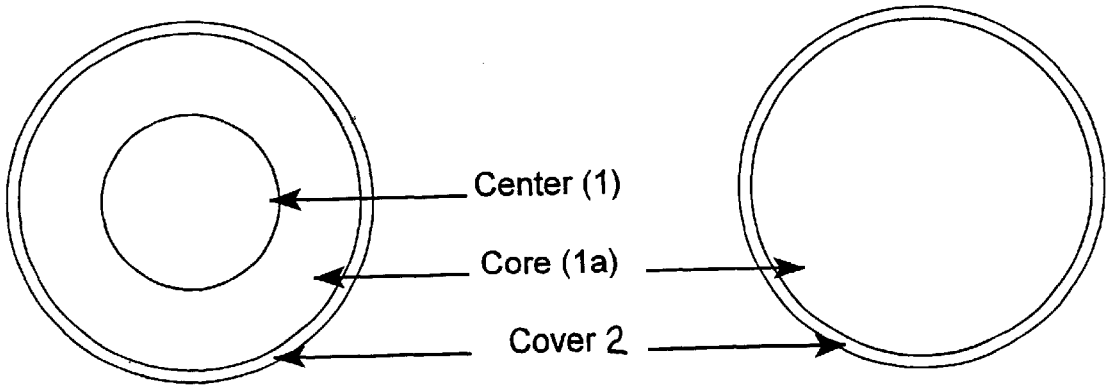
FIG. 1 is a cross section of a three-piece golf ball according to one embodiment of the invention.
FIG. 2 is a cross section of a two-piece golf ball according to one embodiment of the invention.

As is well known in the art, fillers can be incorporated into golf ball cores and centers to increase the weight of the resulting golf ball. It has now been discovered that the utilization of high density fillers having specific gravities of about 5.4 or greater can be used to increase the weight of a golf ball center 1 having a conventional rubber winding layer 1*a* (as shown in FIG. 1), or core 1*a* (as shown in FIG. 2) without significantly reducing the rebound characteristics of the resulting golf ball which further comprises cover 2.

The following table contains a list of high density inorganic elements that meet the aforementioned criteria. The list is provided by way of illustration and not limitation. The key criteria is that the filler material must have a specific gravity of at least about 5.6.

TABLE 1

| Inorganic Element | Specific Gravity |
|---|---|
| Tungsten | 19.3 |
| Bismuth | 9.8 |
| Copper | 8.9 |
| Bismuth oxide | 8.9 |
| Nickel | 8.9 |
| Cobalt | 8.9 |
| Iron/Steel | 7.7 |
| Tin | 7.3 |
| Chromium | 7.2 |
| Zinc | 7.1 |
| Bismuth subcarbonate | 6.9 |
| Cupric oxide | 6.4 |
| Barium tungstate | 6.4 |
| Cuprous oxide | 6.0 |
| Ferrous oxide | 5.7 |

In one embodiment, centers or cores incorporating such fillers are prepared by dry mixing polybutadiene rubber with the filler of choice and other rubber vulcanizing ingredients to create the desired blend. Mixing can be accomplished in an internal mixer such as a Banbury mixer or an open mill as is well known in the art. The mixture is then sheeted and allowed to cool for preferably 8 hours minimum.

The sheeted material is then placed in a warm up mill and heated to about between 110° F. to 160° F. The sheets are then stripped off the mill of desired thickness and width and fed into an extruder. A die of desired geometric shape converts the sheets into extrudate which is cut into plugs of desired weight. The plugs are then optionally fed into a duster to dust the plugs to prevent the plugs from adhering to each other.

Next, the plugs are placed into compression molds for final forming. For purposes of forming golf ball cores or centers, the plugs are heated under pressure in the molds to preferably at least 290° F. as is well known in the art to ensure peroxide activation. The molded cores or centers are maintained in the molds until cured. As is well known in the art, the amount of time needed to cure the cores and centers is a product of the peroxide activity. The end result is a core or center having the desired diameter.

The following examples are illustrative of the advantages obtains by using high density fillers. The amounts of compound components are specified as being parts per hundred parts by weight of rubber unless specified otherwise. As used herein, "high cis" shall mean a cis content of 92% or greater. The same specific gravity was maintained for all three compounds to give the same weight after molding of the cores. Only part levels of the weight enhancing filler was varied in the compound.

EXAMPLE 1

| COMPOUND | A | B | C |
|---|---|---|---|
| High cis polybutadiene | 100 | 100 | 100 |
| Zinc diacrylate | 29.5 | 29.5 | 29.5 |
| Zinc oxide | 5 | 5 | 5 |
| Zinc stearate | 3 | 3 | 3 |
| Core regrind | 7.5 | 7.5 | 7.5 |
| Peroxide | 2.125 | 2.125 | 2.125 |
| Calcium carbonate (2.73) | 20.805 | — | — |
| Zirconium dioxide (5.50) | — | 15.285 | — |
| Tungsten (19.3) | — | — | 12.875 |
| Total | 167.930 | 162.410 | 160.000 |
| Compound specific gravity | 1.139 | 1.139 | 1.139 |
| Volume occupied by filler (%) | 5.17 | 1.95 | 0.48 |
| CORE DATA: | | | |
| Size (inches) | 1.54 | 1.54 | 1.54 |
| Weight (g) | 36.7 | 36.8 | 36.7 |
| Compression (PGA) | 95.7 | 89.3 | 83.0 |
| Coefficient of restitution | 0.695 | 0.697 | 0.702 |
| BALL DATA: | | | |
| Size (inches) | 1.68 | 1.68 | 1.68 |
| Weight (g) | 45.3 | 45.2 | 45.1 |
| Compression (PGA) | 103.6 | 97.3 | 93.2 |
| Coefficient of restitution | 0.703 | 0.706 | 0.706 |
| FLIGHT DATA: | | | |
| Driver; carry (yards) | 245.5 | 245.7 | 246.3 |

As clearly demonstrated by the test results, the use of heavy weight fillers results in a desirable lower PGA compression and a higher coefficient of restitution relative to a core or center made with a filler having a lower specific gravity. When a filler having a relatively low specific gravity is used, inevitably more filler has to be used to meet the desired weight range for the core or center. The increased amounts of filler results in the reduction of other compound components. It is this reduction that leads to the increase in PGA compression and decrease in coefficient of restitution.

It will be appreciated that the instant specification and claims are set forth by way of illustration and made without departing from the spirit and scope of the present invention.

Having thus described my invention, what I claim as new and desire to secure by United States Letters Patent is:

1. A method of increasing the weight of a golf ball core comprising the steps of:

providing polybutadiene rubber;

mixing an inorganic filler having a specific gravity equal to or greater than about 5.6 with the polybutadiene rubber to form a mixture;

molding the mixture of polybutadiene rubber and inorganic filler into a golf ball core;

sheeting the mixture of polybutadiene and inorganic filler into at least one sheet;

cooling the at least one sheet;

warming the at least one sheet in a warm up mill;

stripping the at least one sheet off the warm up mill;

extruding the at least one sheet into at least one plug; and, compressing the at least one plug into at least one core in a compression mold.

2. The method of claim 1 wherein the inorganic filler mixed with the polybutadiene rubber is selected from the group consisting of tungsten, bismuth, copper, bismuth oxide, nickel, cobalt, iron, steel, tin, chromium, zinc, bismuth subcarbonate, cupric oxide, barium tungstate, cuprous oxide and mixtures thereof.

3. The method of claim 2 including the further step of curing the at least one core in the compression mold.

4. The method of claim 1 wherein the inorganic filler is tungsten.

5. A method of increasing the weight of a golf ball center comprising the steps of:

providing polybutadiene rubber;

mixing an inorganic filler having a specific gravity equal to or greater than about 5.6 with the polybutadiene rubber to form a mixture;

molding the mixture of polybutadiene rubber and inorganic filler into a golf ball center;

sheeting the mixture of polybutadiene and inorganic filler into at least one sheet;

cooling the at least one sheet;

warming the at least one sheet in a warm up mill;

stripping the at least one sheet off the warm up mill;

extruding the at least one sheet into at least one plug; and, compressing the at least one plug into at least one center in a compression mold.

6. The method of claim 5 wherein the inorganic filler mixed with the polybutadiene rubber is selected from the group consisting of tungsten, bismuth, copper, bismuth oxide, nickel, cobalt, iron, steel, tin, chromium, zinc, bismuth subcarbonate, cupric oxide, barium tungstate, cuprous oxide and mixtures thereof.

7. The method of claim 5 wherein the inorganic filler is tungsten.

8. The method of claim 5 including the further step of curing the at least one center in the compression mold.

9. A method of increasing the weight of a golf ball comprising the steps of:

providing polybutadiene rubber;

mixing an inorganic filler having a specific gravity equal to or greater than about 5.6 with the polybutadiene rubber to form a mixture;

forming the mixture of polybutadiene rubber and inorganic filler into a golf ball core;

sheeting the mixture of polybutadiene and inorganic filler into at least one sheet;

cooling the at least one sheet;

warming the at least one sheet in a warm up mill;

extruding the at least one sheet into at least one plug;

compressing the at least one plug into at least one center in a compression mold; and, providing a cover around the core.

10. A method of increasing the weight of a golf ball comprising the steps of:

providing polybutadiene rubber;

mixing an inorganic filler having a specific gravity equal to or greater than about 5.6 with the polybutadiene rubber to form a mixture;

forming the mixture of polybutadiene rubber and inorganic filler into a golf ball center;

sheeting the mixture of polybutadiene and inorganic filler into at least one sheet;

cooling the at least one sheet;

warming the at least one sheet in a warm up mill;

extruding the at least one sheet into at least one plug; and, compressing the at least one plug into at least one center in a compression mold;

curing the at least one core in the compression mold placing a thread winding layer around the center; and, providing a cover around the center and thread winding layer.

11. The method of claim 10 wherein the inorganic filler mixed with the polybutadiene rubber is selected from the group consisting of tungsten, bismuth, copper, bismuth oxide, nickel, cobalt, iron, steel, tin, chromium, zinc, bismuth subcarbonate, cupric oxide, barium tungstate, cuprous oxide and mixtures thereof.

12. The method of claim 10 wherein the inorganic filler is tungsten.

13. The method of claim 10 wherein the center further comprises zinc diacrylate and peroxide.

14. The method of claim 10 further comprising the step of:

measuring the golf ball to ensure that the golf ball has a PGA compression of about 93.2 and 103.6 or a coefficient of resitution of about 0.703 or 0.706.

* * * * *